United States Patent [19]

Nitta

[11] 4,201,537

[45] May 6, 1980

[54] FUEL TANK OF A DISPOSABLE CIGARETTE GAS LIGHTER

[75] Inventor: Tomio Nitta, Yokohama, Japan

[73] Assignee: Tokai Seiki Co., Ltd., Yokohama, Japan

[21] Appl. No.: 876,484

[22] Filed: Feb. 9, 1978

[51] Int. Cl.[2] ..... F23D 13/04

[52] U.S. Cl. ..... 431/344; 431/276; 220/20.5

[58] Field of Search ..... 220/20.5, 20; 431/344, 431/142, 143, 254, 255, 130, 131, 276, 277

[56] References Cited

U.S. PATENT DOCUMENTS

| | | | |
|---|---|---|---|
| 970,797 | 9/1910 | Clark | 220/20 |
| 1,145,472 | 7/1915 | Durand | 220/20.5 |
| 2,318,778 | 4/1943 | Hines | 220/20 |
| 2,503,640 | 4/1950 | Speck | 220/20 |
| 2,583,691 | 1/1952 | Florman | 220/20.5 |
| 3,092,988 | 6/1963 | Meyers | 431/344 |
| 3,154,935 | 11/1964 | Ayers | 431/344 |
| 3,292,779 | 12/1966 | Colella | 220/20 |
| 3,464,578 | 9/1969 | Quercia | 431/344 |
| 3,542,261 | 11/1970 | Greenberg | 220/20.5 |
| 3,642,163 | 2/1972 | McFarland | 220/5 A |
| 3,837,527 | 9/1974 | Kutik et al. | 220/20.5 |

*Primary Examiner*—Joseph Man-Fu Moy
*Attorney, Agent, or Firm*—Gerald J. Ferguson, Jr.; Joseph J. Baker

[57] ABSTRACT

A fuel tank of a disposable cigarette gas lighter is constituted of a tubular tank body of uniform cross section having a plurality of borings, a bottom cap attached to the lower end of the tank body and a lighting means holder attached to the upper end of the tank body. A part of the wall between the borings of the tank body is removed at either end thereof to provide a communicating path between the borings. The tank body which shares the major portion of the fuel tank is produced by cutting a continuous pipe of uniform cross section having a plurality of borings made by extrusion molding.

13 Claims, 23 Drawing Figures

FUEL TANK OF A DISPOSABLE CIGARETTE GAS LIGHTER

BACKGROUND OF THE INVENTION

1. Field of the Invention

This invention relates to a disposable ciagarette gas lighter, and more particularly to a fuel tank of a disposable cigarette gas lighter formed of plastics.

2. Description of the Prior Art

Recently disposable cigarette gas lighters have come into wide use. Such disposable cigarette gas lighters generally comprise a fuel tank formed of plastics including a lighting means holder attached to the upper portion thereof. On the holder, lighting means such as a flint, a sparking wheel, a fuel valve actuating lever and a windshield member are mounted. In those components, the cost of the fuel tank shares the major portion of the manufacturing cost of the cigarette gas lighter. Accordingly, in order to lower the manufacturing cost of the disposable cigarette gas lighter, it is important to lower the cost of the fuel tank thereof.

The fuel tank has conventionally been prepared by a plastic injection molding process. However, the injection molding process is economically disadvantageous since it requires a costly mold and an expensive equipment.

SUMMARY OF THE INVENTION

Thus, the primary object of the present invention is to provide a fuel tank for a disposable cigarette gas lighter which can be produced at a low cost.

Another object of the present invention is to provide a fuel tank for a disposable cigarette gas lighter whose major part can be produced by plastic extrusion molding, whereby the total manufacturing cost of the fuel tank can be markedly lowered.

The fuel tank of this invention comprises a tank body having upper and lower ends and a plurality of borings extending in parallel between the ends, a lighting means holder attached to the upper end of the tank body, a bottom cap attached to the lower end of the tank body in a liquid tight fashion, and a means for providing a communicating path between said borings, said tank body being produced by cutting a continuous tubular member of uniform cross section having a plurality of borings obtained by extrusion molding.

As described above, in the fuel tank of this invention, its major part, i.e., the tank body is produced by a plastic extrusion molding process which is economically advantageous relative to a plastic injection molding process. Therefore, the total manufacturing cost of the fuel tank can be greatly lowered.

In one embodiment of the present invention, said communicating path is provided by forming a cut-off portion on one end of the partition wall between said borings of the tank body.

In another embodiment of the present invention, said communicating path is provided by forming a recess on the upper surface of the bottom cap or the lower surface of the lighting means holder so that the end of the wall between said borings is spaced from the bottom cap or the lighting means holder.

DESCRIPTION OF THE PREFERRED EMBODIMENTS

This invention is intended to provide an improved construction of a fuel tank of a disposable cigarette gas lighter which enables the major portion of the fuel tank to be produced by extrusion molding of plastics thereby lowering the total manufacturing cost of the fuel tank.

Figure 1:
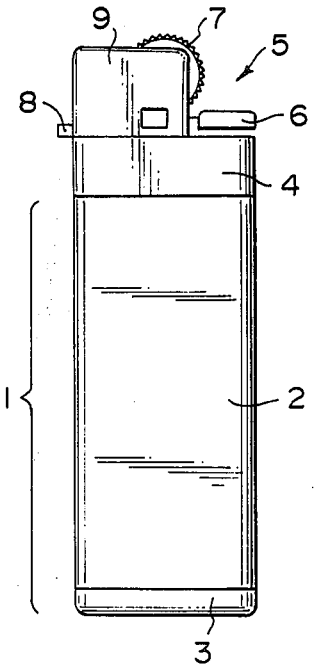
FIG. 1 shows an outside view of a typical fuel tank for a disposable ciagrette gas lighter in accordance with this invention with a lighting means assembly attached thereto.

As shown in FIG. 1 wherein an outside view of a typical fuel tank of this invention with a lighting means assembly attached thereto is shown, the fuel tank 1 of this invention generally comprises a tank body 2, a bottom cap 3 and a lighting means holder 4 on which lighting means assembly 5 including a plurality of components such as a fuel valve actuating lever 6, a sparking wheel 7, a flame adjusting lever 8, a windshield member 9 and the like are supported.

In accordance with this invention, the tank body 2 is produced by cutting a continuous tubular member of a uniform cross section having a plurality of borings and obtained by extrusion molding of plastics.

Figure 2:
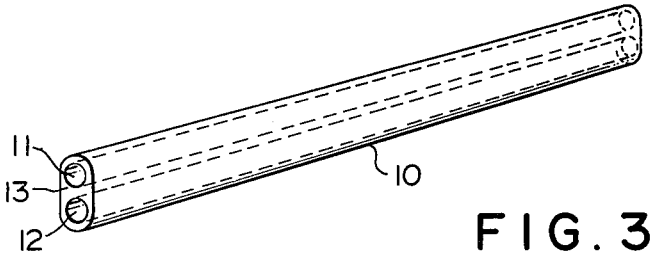
FIG. 2 is a perspective view of an example of a continuous tubular member obtained by an extrusion molding process.

An example of such a continuous tubular member is shown in FIG. 2. As shown in FIG. 2 the tubular member 10 has a pair of borings 11 and 12 extending in parallel along the longitudinal direction thereof and has a uniform cross section over the entire length thereof. Said borings 11 and 12 are partitioned by a partition wall 13.

Figure 3:
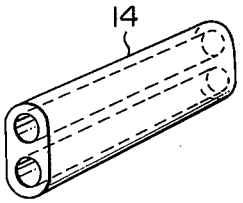
FIG. 3 is a perspective view of a cut piece obtained by cutting the tubular member shown in FIG. 2.
Figure 5:
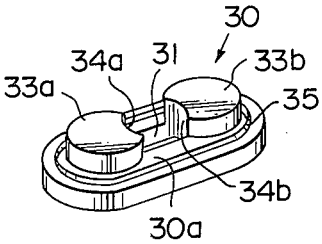
FIG. 5 is a perspective view of the bottom cap employed in the fuel tank shown in FIG. 4.
Figure 6:
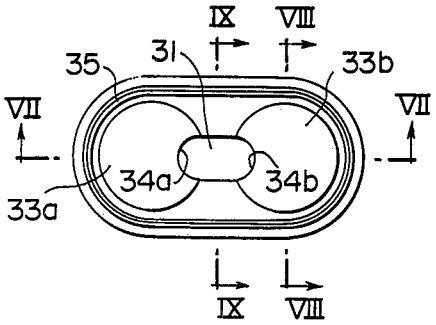
FIG. 6 is a plan view of the bottom cap shown in FIG. 5.
Figure 7:
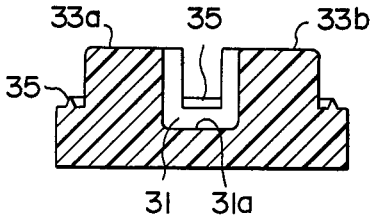
FIG. 7 is a cross sectional view taken along the line VII—VII of FIG. 6.

The tubular member 10 is cut into a plurality of cut pieces 14 of a desired length having a substantially flat ends as shown in FIG. 3.

The cut piece 14 can be used as a tank body 2 as it is or by being properly processed. The resulting tank body has a pair of separate borings. Therefore, when assembling the fuel tank, the borings must be communicated with each other.

Thus the tank body 2, the bottom cap 3 and the lighting means holder 4 are shaped so that a path communicating the borings 11, 12 is formed adjacent to either end of the tank body 2 when they are assembled. The communicating path can be provided by removing a part of the partition wall 13 between the borings 11, 12 of the cut piece 14 at either end thereof, or by providing a recess on the upper surface of the bottom cap 3 or the lower surface of the lighting means holder 4 so that an end surface of the partition wall 13 is spaced from either the bottom cap 3 or the holder 4.

Figure 4:
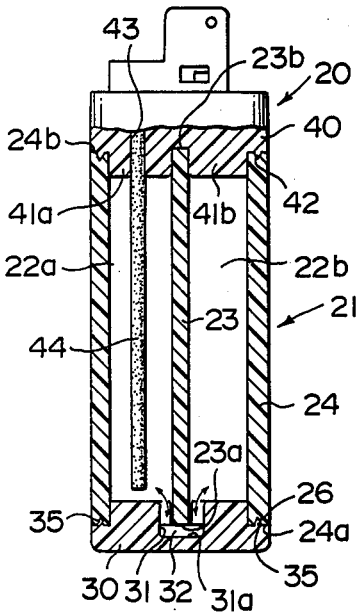
FIG. 4 is a cross sectional view of a fuel tank constructed in accordance with an embodiment of this invention.

FIG. 4 shows an embodiment of the present invention in which a path communicating the borings is provided by virtue of a recess formed in the bottom cap 3.

As shown in FIG. 4, the fuel tank 20 of this embodiment comprises a tank body 21, a bottom cap 30 attached to the lower end of the tank body 21 and a lighting means holder 40 attached to the upper end of the tank body 21. The tank body 21 has a pair of borings **22*a* and 22*b* of generally circular cross section extending in parallel between the upper and lower ends thereof. The borings 22*a* and 22*b* are partitioned by a partition wall 23 and surrounded by a peripheral wall 24. The lower end surfaces 23*a* and 24*a* of the partition wall 23 and the peripheral wall 24, respectively as well the upper end surfaces 23*b* and 24*b*** thereof are flush with each other.

The lighting means holder 40 is attached to the upper end of the tank body 21 with a pair of circular positioning projections **41*a* and 41*b* formed on its lower surface being snugly inserted into the respective borings 22*a* and 22*b* of the tank body 21 and with an endless protrusion 42 formed on its lower surface surrounding the projections 41*a* and 41*b*. The protrusion 42 functions to firmly bond the holder 40 to the upper end surface 24*b* of the peripheral wall 24 of the tank body 21. The holder 40 is bonded to the tank body 21** by a suitable means such as ultrasonic welding or adhesion.

Further, the lighting means holder 40 is provided with a through opening 43 through which a wick 44 is to be inserted into the boring **22*a*** containing liquid gas fuel.

Said bottom cap 30 has a channel-like recess 31 which provides a space between the partition wall 23 of the tank body 21 and the bottom cap 30 when the bottom cap 30 is attached to the tank body 21 as shown in FIG. 4, thereby providing a path 32 communicating the borings **22*a* and 22*b***.

The bottom cap 30 will be described in more detail hereinafter referring to FIGS. 5 to 9. As shown in FIGS. 5 to 9, the bottom cap 30 has a pair of substantially cylindrical projections **33*a* and 33*b* which project upwardly from the upper surface 30*a* thereof. The projections 33*a* and 33*b* are respectively snugly received in said borings 22*a* and 22*b* of the tank body 21 for precisely positioning the bottom cap 30 with respect to the tank body 21 when the cap 30** is attached thereto.

The inner parts of the projections **33*a* and 33*b* are cut away to form respective cut-off portions 34*a* and 34*b*. Said channel-like recess 31 extends between the cut-off portions 34*a* and 34*b*. When the bottom cap 30 is attached to the tank body 21, the lower end surface 24*a* of the tank body 21 rests on the upper surface 30*a* thereof. Therefore, a space is provided between the lower end surface 23of the partition wall 23 and the bottom surface 31*a* (FIG. 7) of the recess 31. At the same time, said cut-off portions 34*a* and 34*b* serve to provide spaces on both sides of the partition wall 23. The spaces between the partition wall 23 and the bottom cap 30 form the above described path 32 which communicates the borings 22*a* and 22*b***, thereby permitting the liquid gas fuel to flow from one boring to the other.

The bottom cap 30 is bonded to the tank body 21 by a suitable means such as ultrasonic welding and their effective bonding is ensured by an endless protrusion 35 which bites on the lower end surface **24*a* of the peripheral wall 24 of the tank body 21 as shown in FIG. 4**.

Said cylindrical projections **33*a* and 33*b* are used for precisely positioning the bottom cap 30 with respect to the tank body 21. Accordingly, other positioning means as shown in FIGS. 10 to 13 may be used in place of the projections 33*a* and 33*b***.

FIGS. 10 to 13 show two examples of the bottom cap having a positioning means of different type.

Figure 10:
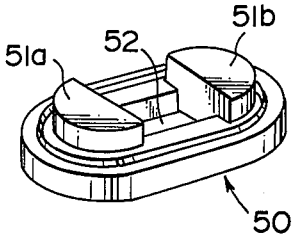
FIG. 10 is a perspective view of another example of a bottom cap which is to be attached to the tank body shown in FIG. 4.
Figure 8:
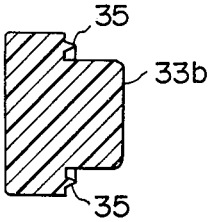
FIG. 8 is a cross sectional view taken along the line VIII—VIII of FIG. 6.
Figure 9:
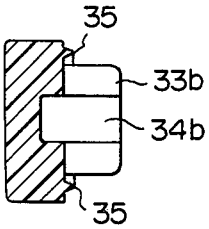
FIG. 9 is a cross sectional view taken along the line IX—IX of FIG. 6.
Figure 11:
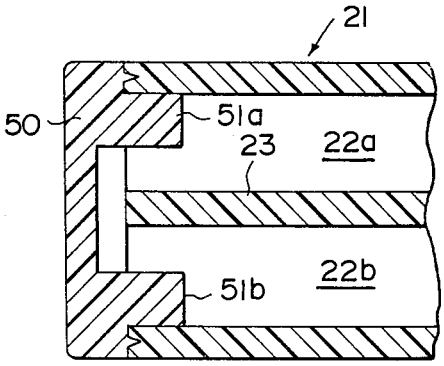
FIG. 11 is a fragmentary cross sectional view showing a manner in which the bottom cap of FIG. 10 is attached to the tank body.

In FIG. 10 the bottom cap 50 of this example includes a pair of semicylindrical projections **51*a* and 51*b* of which inner surfaces are flat. Between the flat inner surfaces of respective projections 51*a* and 51*b*, a recess 52 is formed. The projections 51*a* and 51*b* serve for precisely positioning the bottom cap 50 with respect to the tank body 51 as shown in FIG. 11 in a manner similar to the cylindrical projections 33*a* and 33*b* shown in FIG. 5 except that the spaces on both sides of the partition wall 23 of the tank body 21** are somewhat widened.

Figure 12A:
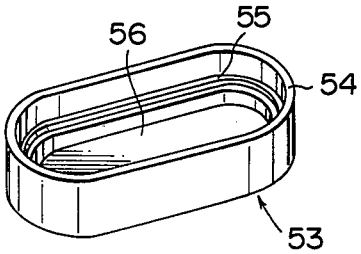
FIG. 12A is a perspective view of still another example of a bottom cap which is to be attached to the tank body shown in FIG. 4.
Figure 12B:
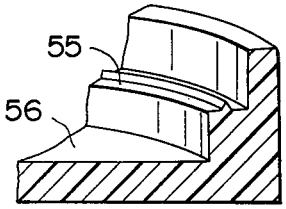
FIG. 12B is an enlarged fragmentary perspective view, partly in cross section, of the bottom cap shown in FIG. 12A.

In a bottom cap 53 shown in FIGS. 12A and 12B, the positioning means is provided in a form of a vertical peripheral wall 54 extending beyond the upper surface 55 of the cap 53.

Figure 13:
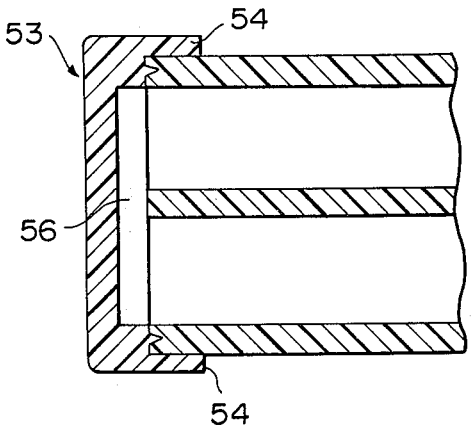
FIG. 13 is a fragmentary cross sectional view similar to FIG. 11 showing a manner in which the bottom cap of FIG. 12 is attached to the tank body.

The peripheral wall 54 snugly receives and surrounds the lower end portion of the tank body 21 as shown in FIG. 13 to precisely position the bottom cap 53 with respect to the tank body 21. In this example the recess for providing a communicating path extends to cover the whole area of the borings **22*a* and 22*b* as indicated at 56**.

Further, when one of the bottom cap and the tank body is precisely guided with respect to the other by means of a suitable guiding jig or device upon assembling, the positioning means as described above can be eliminated.

Figure 14:
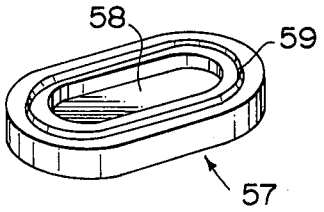
FIG. 14 is a perspective view showing still another example of a bottom cap which is to be attached to the tank body shown in FIG. 4.

FIG. 14 shows a bottom cap 57 which only includes a recess 58 for providing the communicating path between the borings 22*a* and 22*b*, and an endless protrusion 59 for ensuring effective bonding of the bottom cap to the tank body.

Figure 15:
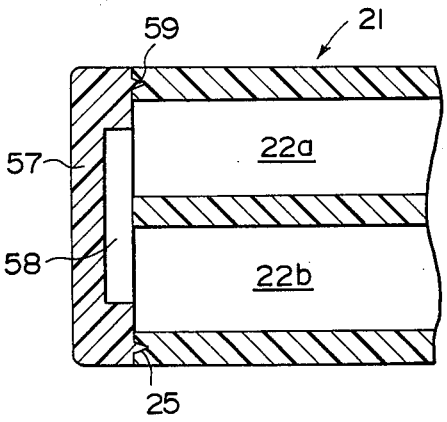
FIG. 15 is a fragmentary cross sectional view similar to FIG. 11 showing a manner in which the bottom cap of FIG. 14 is attached to the tank body.

When the bottom cap 57 is bonded to the tank body 21, the endless protrusion 59 bites the end surface of the tank body 21, and the recess 58 provides a communicating path between the borings 22*a* and 22*b* as shown in FIG. 15.

In the above described embodiments, the path communicating the borings of the tank body is provided adjacent to the lower end of the tank body. However the communicating path may be provided adjacent to the upper end of the tank body.

Figure 16:
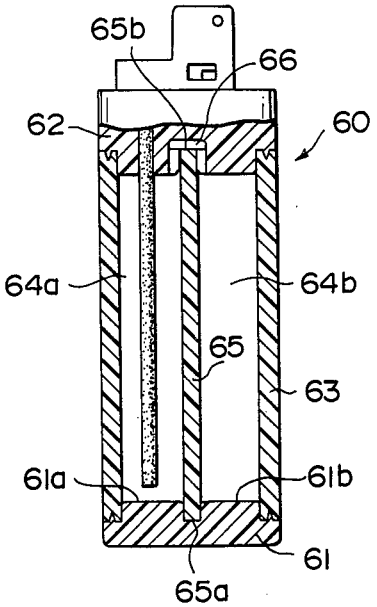
FIG. 16 is a cross sectional view of a fuel tank of another embodiment of the present invention.

In another embodiment of the present invention shown in FIG. 16 the communicating path is provided by forming a recess on the lower surface of the lighting means holder. As shown in FIG. 16, a fuel tank 60 of this embodiment includes a bottom cap 61 and a lighting means holder 62 which are respectively attached to the lower and upper ends of a tank body 63. The tank body 63 is of almost the same shape as the tank body 21 shown in FIG. 4. The bottom cap 61 includes a pair of positioning projections 61*a* and 61*b* which are snugly inserted into a pair of borings 64*a* and 64*b* of the tank body 63. The bottom cap 61 has no recess for providing a communicating path and the lower end surface 65*a* of a partition wall 25 is pressed against the upper surface of the bottom cap 61. At the same time, said positioning projections 61*a* and 61*b* close the lower end portion of the borings 64*a* and 64*b*.

The lighting means holder 62 is provided with a recess 66 adjacent to the upper end surface 65*b* of the partition wall 65. The recess 66 serves to provide a communicating path between the borings 64*a* and 64*b* in a manner similar to that of the bottom caps described above.

In the above described embodiments of this invention, the path communicating the borings of the tank body is provided by virtue of the recess formed either in the bottom cap or in the lighting means holder. However, the communicating path may be provided by removing a part of the partition wall adjacent to the upper or lower end therof as shown in FIG. 17.

When using a tank body 71 having a cut-off portion 72 between a pair of borings 73*a* and 73*b*, the bottom cap attached to the tank body 71 need not be provided with a recess such as employed in the above embodiments.

Figure 17:
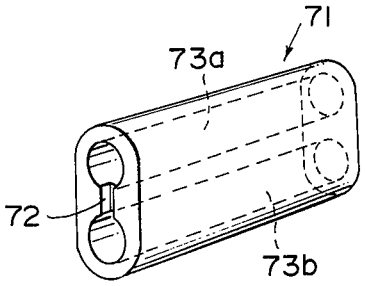
FIG. 17 is a perspective view showing a tank body employed in a fuel tank of still another embodiment of the present invention.
Figure 18:
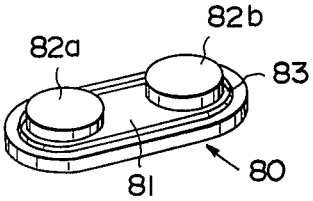
FIG. 18 is a perspective view showing an example of a bottom cap which is to be attached to the tank body of FIG. 17.

FIG. 18 shows an example of a bottom cap used with the tank body 71 shown in FIG. 17. The bottom cap 80 shown in FIG. 18 includes a flat upper surface 81 on which a pair of positioning projections 82*a* and 82*b* of a cylindrical shape and an endless protrusion 83 are formed.

Figure 19:
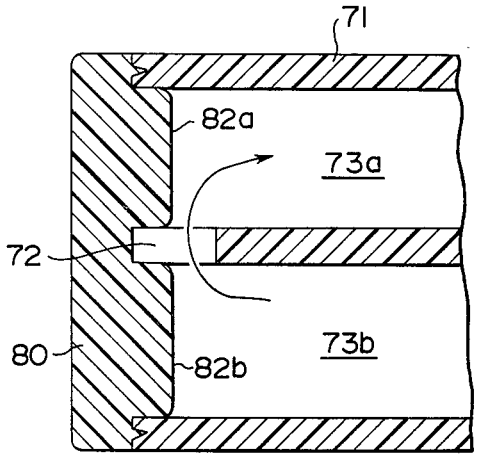
FIG. 19 is a fragmentary cross sectional view showing a manner in which the bottom cap of FIG. 18 is attached to the tank body of FIG. 17.

The positioning projection 82*a* and 82*b* are snugly received in the borings 73*a* and 73*b* to precisely position the bottom cap 80 with respect to the tank body 70 in a manner similar to that employed in the above described embodiments. In this case, the depth of the cut-off portion 72 should be larger than that of the projections 82*a* and 82*b* so that the cut-off portion 72 is not closed thereby when the bottom cap 80 is bonded to the tank body 71 as shown in FIG. 19.

Figure 20:
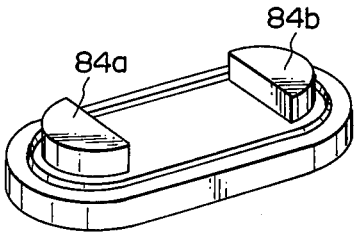
FIG. 20 is a perspective view showing another example of a bottom cap which is to be attached to the tank body shown in FIG. 17.
Figure 21:
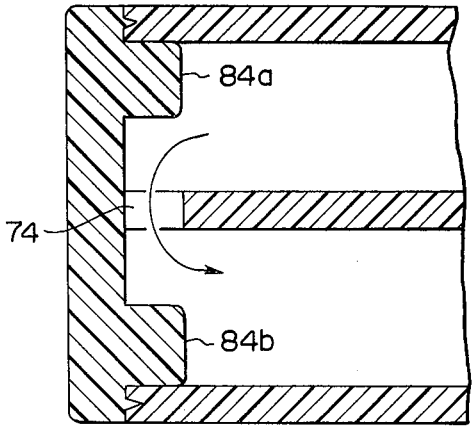
FIG. 21 is a fragmentary cross sectional view similar to FIG. 19 showing a manner in which the bottom cap of FIG. 20 is attached to the tank body.

The positioning projections 82*a* and 82*b* position the bottom cap 80 with respect to the tank body 71 and accordingly may be of any shape. For example, they may be of semicylindrical shape as indicated at 84*a* and 84*b* in FIG. 20. The bottom cap shown in FIG. 20 is attached to the tank body as shown in FIG. 21. In this case, the depth of a cut-off portion 74 is not so important since only the outer half of each borings is closed by the projections 84*a* and 84*b*.

Figure 22:
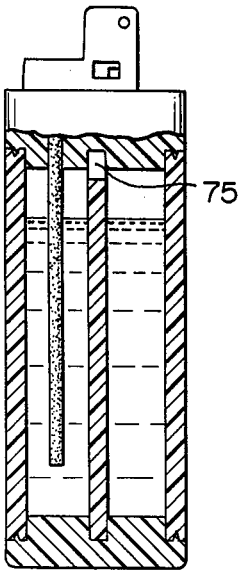
FIG. 22 is a cross sectional view of a fuel tank in accordance with still another embodiment of the present invention.

The communicating path may be provided adjacent to the lighting means holder by cutting away a part of the partition wall at the upper end thereof as shown at 75 in FIG. 22.

Said cut-off portion 72, 74 or 75 can be readily formed by fusing a part of the partition wall by heat or ultrasonic tooling device or by mechanical processing. When producing lighters in an automatic production system, a plurality of cut pieces such as shown in FIG. 3 are transported by a belt conveyor and oriented in one direction so that one end surface thereof is automatically put into contact with the ultrasonic tooling device and a part of the partition wall is fused.

In the above described embodiments of this invention, the tank body has only a pair of borings. However, the tank body may have three or more borings and by suitably arranging positions of these borings relative to each other, various shapes of tank body can be readily produced.

Preferably, the tank body should be transparent so that the quantity of the liquid gas fuel remaining in the tank can be seen through the peripheral wall thereof.

I claim:

1. A cigarette gas lighter comprising an extruded, one-piece tubular tank body of uniform cross section at least in the longitudinal direction thereof having upper and lower ends and a plurality of borings partitioned by at least one partition wall and extruding in parallel from and to and between the ends in said longitudinal direction of the tank body, a holder including a lighting means attached to the upper end of the tank body, a bottom cap attached to the lower end of the tank body in a liquid tight fashion where said tank body, said holder and said bottom cap comprise three separate members, and means for providing a communicating path between said borings, said tank body being produced by cutting a continuous tubular member of uniform cross section having said plurality of borings obtained by extrusion molding of plastics, and said borings being partitioned by said partition wall and surrounded by a peripheral wall.

2. A fuel tank as defined in claim 1 wherein said bottom cap includes a generally flat upper surface on which the lower end surface of the tank body rests.

3. A fuel tank as defined in claim 2 wherein said communicating path is a recess formed on the upper surface of the bottom cap, the recess being located at a part thereof to which the lower end surface of the partition wall is to rest and having a length larger than the thickness of the partition wall.

4. A fuel tank as defined in claim 3 wherein said tank body has a pair of borings and said bottom cap has a pair of positioning projections formed on the upper surface thereof and snugly received in the respective borings to precisely position the bottom cap with respect to the tank body.

5. A fuel tank as defined in claim 4 wherein said borings are of substantially circular cross section and said positioning projections are of generally cylindrical shape having an outside diameter substantially equal to the inner diameter of the borings, at least a part of the projections adjacent to the partition wall being cut away to form a cut-off portion, and said recess extending between the cut-off portions.

6. A fuel tank as defined in claim 4 wherein said positioning projections are of semicylindrical shape with their flat side surfaces facing against each other and said recess extends between the flat surfaces of the projections.

7. A fuel tank as defined in claim 3 wherein said bottom cap includes a vertically upwardly extending peripheral wall extending beyond the upper surface thereof, said peripheral wall snugly receiving the lower portion of the tank body to precisely position the bottom cap with respect to the tank body.

8. A fuel tank as defined in claim 3 wherein said bottom cap is bonded to the tank body by means of ultrasonic welding.

9. A fuel tank as defined in claim 8 wherein said bottom cap includes an endless protrusion which bites a lower end surface of the tank body for ensuring effective bonding of the bottom cap to the tank body.

10. A fuel tank as defined in claim 1 wherein said lighting means holder has a lower surface and said communicating path is a recess formed on the lower surface of the lighting means holder.

11. A fuel tank as defined in claim 10 wherein said holder includes an endless protrusion which bites the upper end surface of the tank body for ensuring effective bonding of the holder to the tank body.

12. A fuel tank as defined in claim 1 wherein said communicating path is a cut-off portion formed on either end of the partition wall of the tank body.

13. A fuel tank as defined in claim 1 wherein said tank body is transparent.

* * * * *